US006965301B2

(12) United States Patent
Epstein et al.

(10) Patent No.: US 6,965,301 B2
(45) Date of Patent: Nov. 15, 2005

(54) ABUSE RESISTANT DOORBELLS

(76) Inventors: Ari Epstein, 13120 Huston St., Sherman Oaks, CA (US) 91423; Natan Epstein, 119 No. Oakhurst Dr., Beverly Hills, CA (US) 90210-5504

( * ) Notice: Subject to any disclaimer, the term of this patent is extended or adjusted under 35 U.S.C. 154(b) by 267 days.

(21) Appl. No.: 10/619,733

(22) Filed: Jul. 14, 2003

(65) Prior Publication Data

US 2005/0012609 A1 Jan. 20, 2005

(51) Int. Cl.[7] ..... G08B 1/00
(52) U.S. Cl. ..... 340/309.16; 340/384.71
(58) Field of Search ..... 340/309.16–309.9, 340/326, 330, 328–29, 384.1, 384.7, 384.71, 388.1, 5.28, 5.31; 368/1, 10, 89; 381/101

(56) References Cited

U.S. PATENT DOCUMENTS 4,868,540 A * 9/1989 Housley ..... 340/326
5,210,520 A * 5/1993 Housley ..... 340/326
5,774,039 A * 6/1998 Housley ..... 340/326

* cited by examiner

*Primary Examiner*—Daniel Wu
*Assistant Examiner*—Travis R Hunnings
(74) *Attorney, Agent, or Firm*—Law Offices of Natan Epstein

(57) ABSTRACT

Protection against abusive ringing of doorbells is provided by a ring limiting circuit including ring counter and ring timer circuits.

14 Claims, 1 Drawing Sheet

ABUSE RESISTANT DOORBELLS

BACKGROUND OF THE INVENTION

1. Field of the Invention

This invention pertains to the field of doorbells, ringers and other signaling devices such as are installed near a doorway of a dwelling and used to announce the arrival of visitors.

2. State of the Prior Art

Exterior doors of homes and other dwellings are commonly equipped with a doorbell by which a visitor may announce him or herself to those inside the dwelling. The doorbells typically include a push-button electrical switch mounted on an exterior wall or other support outside the dwelling. The doorbell switch is operatively connected, either by electrical wiring or a wireless link, to an interior signaling device such as an electromechanical ringer or electronic tone generator mounted inside the dwelling. The interior signaling device is actuated when the exterior doorbell switch is pressed by a visitor.

Such doorbells are, however, subject to abuse when repeatedly or continuously pressed by pranksters or others intent on annoying or harassing the occupants of the dwelling, or simply by an impatient visitor who repeatedly or continuously rings the bell until someone responds.

Three forms of abusive doorbell ringing can be identified. A first form of abuse occurs when the door bell is rung repeatedly many times in rapid succession within a relatively short period of time. A second form of abuse occurs when the door bell is rung only a few times but with rings of excessively long duration, such that each ring alone would not be objectionable but in combination the rings add up to excessive bell ringing time within some preset time interval. A third form of abuse occurs where the door bell is rung only once but is rung continuously for an unacceptably long time.

Many modem doorbells are partially protected from abuse in that actuation of the ringer results in playback of a musical tune or sound effect stored in the signaling device, and repeated actuation of the doorbell is ineffective until the tune or sound effect has played out. However, when a short tune or sound effect is selected by the homeowner, the doorbell can be rung repeatedly at an annoyingly high rate. Even long-playing tunes can be replayed unnecessarily. And in continuous ring mode, the doorbells are subject to all forms of abuse mentioned earlier.

Existing doorbell installations lack adequate protection against such abuse and as of yet no practical solution has been proposed to this problem. A continuing need exists for doorbells with built-in protection against harassment caused by abusive ringing of doorbells.

SUMMARY OF THE INVENTION

The aforementioned need is addressed by the invention disclosed herein and which provides an improvement in a doorbell installation of the type having a ringer device such as a push button switch, mounted near an exterior doorway or gate to a dwelling and connected for operating a signaling device, such as an electric bell, buzzer or audio sequence generator, at a location remote from the actuating device where the signal can be heard by occupants of the dwelling or other premises.

The improved doorbell system of this invention can be configured with different combinations of features selected to prevent any one or more of the aforementioned three forms of abusive doorbell ringing.

In a relatively full featured embodiment, the improvement according to this invention includes timer circuits connected for disabling the ringer device for a predetermined rest interval upon the occurrence of one or both of a predetermined total number of actuations of the signaling device within a preset base time interval, or actuations having a total ring duration in excess of a preset total ring length within the preset base time interval irrespective of the number of actuations within the preset base time interval.

The timer circuits may include a base interval timer which is preferably self resetting upon lapse of the base time interval, a ring frequency counter for accumulating a count of ring actuations during the base time interval, and a rest interval timer actuated by the ring frequency counter for timing the rest interval. A ring length timer may be provided for accumulating a total length of ring actuations during the base time interval, and connected for starting the rest interval timer if the total ring length equals the preset total ring length. The rest interval timer is connected for interrupting further actuation of the signaling device after it is started and until the rest interval has timed out. The rest interval is also connected for resetting the base interval timer, the ring frequency counter and the ring length timer upon lapse of the rest time interval thereby resetting the protection system.

Either or both the predetermined number of ring actuations, the total ring length, the base time interval and the rest time interval may be user-adjustable to reflect the individual user's preferences and tolerance.

In alternate simplified embodiments of this invention the ring frequency counter or the ring length counter may be omitted so that the rest interval timer is started only in response to unduly lengthy ringing time or to overly repetitive ringing, respectively. In a minimal embodiment of the system only the ring length timer and the rest interval timer are provided, and both base interval timer and ring frequency timer are omitted, so that limited abuse protection is offered only against continuous rings of excessive length.

In yet another embodiment particularly useful with musical doorbells which once activated play a tune sequence of some length, the base time interval counter, the total ring length counter and ring frequency counter may be omitted, and only a rest time interval counter provided and connected for disabling the signaling device of the doorbell for a preset rest interval following a single actuation of the signaling device. In this embodiment the length of the tune is not under the control of the ringer device, the tune length being the same regardless of how often or how long the ringer is actuated once play of the musical tune has been initiated by the signaling device. Furthermore, actuations of the ringer device while the tune is playing do not normally result in further replays of the tune. The ringer is in effect disabled for the length of the tune once a single actuation is made of the signaling device. In such case, annoying rates of replay of the tune can be prevented by merely disabling actuation of the signaling device for a preset rest interval following a single actuation of the signaling device. In such case also, there is no base time interval to be measured and the base interval timer may be omitted or disabled and the ringer device connected such that a single actuation of the ringer device provides the input operative for starting the rest interval timer. Alternatively, the rest interval timer can be started upon completion of the tune played by the signaling device by means of a start input provided by a suitably modified signaling device, with appropriate adjustment to the length of the rest interval.

These and other improvements, features and advantages will be better understood by reference to the following detailed description of the preferred embodiments in conjunction with the accompanying drawings.

DETAILED DESCRIPTION OF THE PREFERRED EMBODIMENTS

Figure 1:
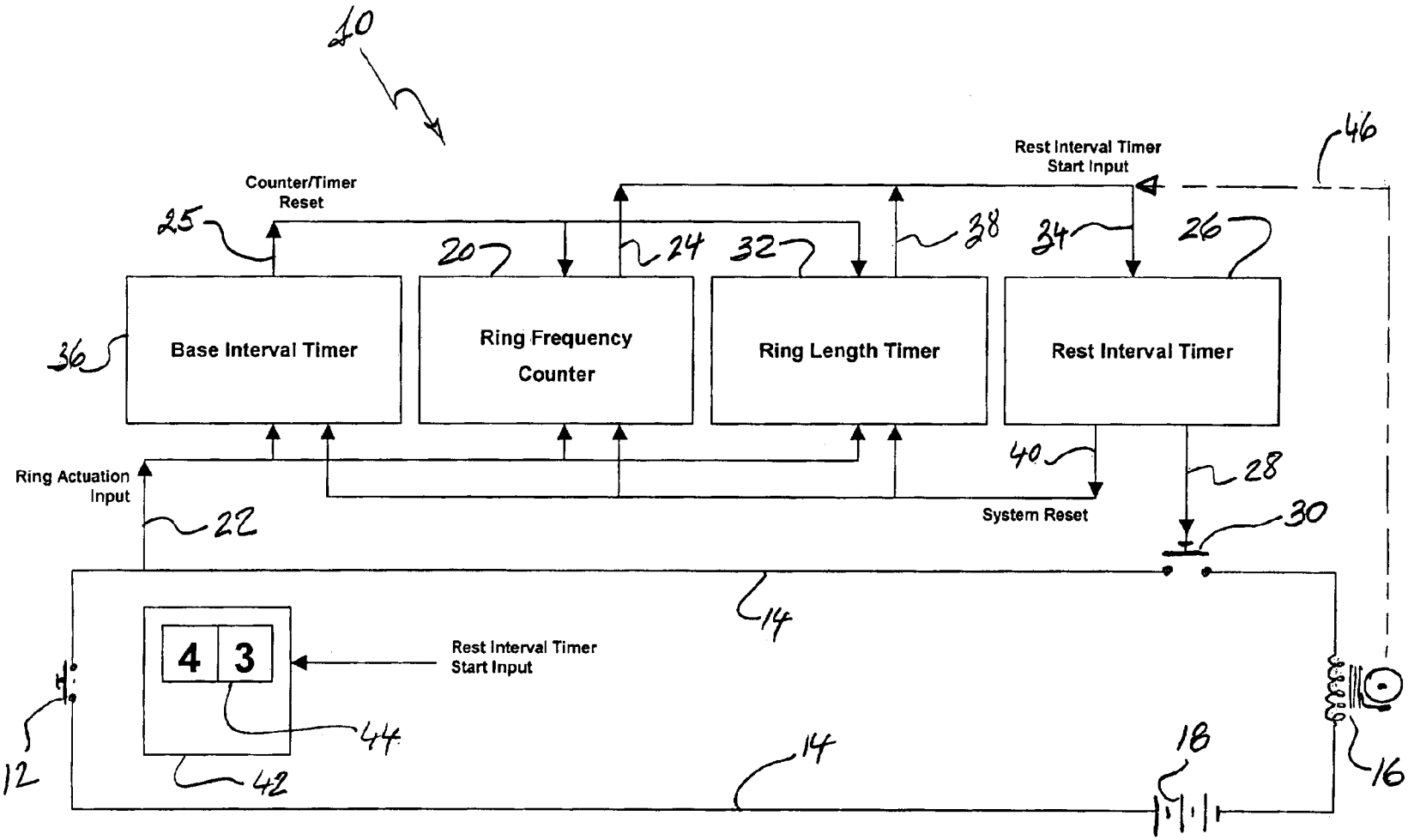
FIG. 1 is a schematic diagram of a doorbell system equipped with the abuse protection system according to this invention.

With reference to FIG. 1 of the accompanying drawing, the numeral 10 generally designates the doorbell system equipped with the abuse protection system according to this invention. The doorbell system 10 includes a ring actuation device which in this example is a push button normally open electrical switch 12 connected by electrical conductors 14 to a remotely located signaling device such as an electric bell, ringer or buzzer 16 of a type which is readily available from electrical and hardware suppliers. Actuation of the ringer switch 12 by manually pushing the switch button closes switch 12 and completes the electrical circuit between electrical power source 18 and the bell 16, thereby applying power to the bell and causing the bell to ring or buzz.

Pressing of the doorbell switch 12 produces a ring actuation input 22 which is a suitable waveform derived either directly from the electrical conductors 14 or through appropriate intervening signal conditioning circuits. The ring actuation input is fed to a base interval timer 36, a ring frequency counter 20 and ring length timer 32. The timer 36 and counter 20 require only pulse or other momentary inputs, while ring length timer 32 needs a continuous or periodic input coextensive with actuation of the doorbell switch 12.

A first ring actuation input upon initial actuation of doorbell switch 12 starts base interval timer 36. Timer 36 runs for a preset base time interval, at the end of which timer 36 self-resets to zero and also outputs a reset signal 25 to both the ring length timer 32 and ring frequency counter 20, restoring timer 32 and counter 20 to zero states.

The base interval timer 36 measures a base time interval associated with stored limits in counter 20 and timer 32. If either of the two stored limits is reached within the base time interval then a rest interval timer 26 is started and a cutoff switch is opened to prevent further ringing of the doorbell until the rest time interval has run. If, on the other hand, neither stored limit is reached within the base time interval, that is, if there is no abusive actuation of the doorbell switch 12, then upon lapse of the base time interval the timer 36 resets itself as well as counter 20 and timer 32, and a new base time interval is started and fresh ring frequency and ring length counts are accumulated by counter 20 and timer 32, respectively.

The ring frequency timer 20 increments with every actuation of doorbell switch 12 and operates to count and store the number of closures of doorbell switch 12 accumulated during a current base time interval. Counter 20 includes a memory which stores a preset limit number of closures, for example a ring limit number of four doorbell switch closures. The stored current closure count is compared against the preset limit number of closures. If the doorbell is pressed four times, thereby closing switch 12 an equal number of times, the stored count of counter 12 reaches the preset limit, whereupon a counter output 24 starts the rest interval timer 26. When timer 26 is started a timer output 28 opens doorbell cutoff switch 30 thereby breaking the doorbell circuit and disabling further actuation of the bell 16 by operation of the doorbell switch 12 for as long as cutoff switch 30 remains open. Rest interval timer 26 is preset for a rest interval, such as 30 seconds, for example, during which the cutoff switch 30 remains open. After the preset rest time interval has run, timer output 28 changes state and returns cutoff switch 30 to a closed state, thereby restoring continuity of the doorbell circuit. Upon lapse of the rest interval, timer 26 also outputs a system reset signal 40 to counter 20, timer 32 and base interval timer 36. The doorbell switch 12 is now again operative for actuating signaling device or bell 16, and a new ring frequency count is accumulated and stored by counter 20 when the switch 12 is again pressed.

The ring length timer 32 receives a ring actuation input and operates to measure or accumulate the time length during which the switch 12 is closed and consequently the total ringing time of doorbell 16 during any current base time interval. A total ring time length is accumulated whether for a single continuous ring or a number of successive rings. The total ring time accumulated is compared to a maximum acceptable ring time limit stored in a memory of timer 32. If the currently accumulated ring time in timer 32 reaches the stored maximum acceptable ring time limit, a timer output 38 starts rest interval timer 26. As previously explained, when timer 26 is started the timer output 28 opens cutoff switch 30 thereby breaking the doorbell circuit and disabling further actuation of the bell 16 by operation of the doorbell switch 12 for as long as cutoff switch 30 remains open. After the preset rest time interval has run, timer output 28 changes state and returns cutoff switch 30 to a closed state, thereby restoring continuity of the doorbell circuit. Upon lapse of the rest interval, timer 26 also outputs a system reset signal 40 to timer 32. The system reset signal resets to zero the accumulated ring time of timer 34 upon expiration of the rest time interval. Actuation of the doorbell switch 12 is now again operative for actuating signaling device or bell 16, and a new total ring time is accumulated and stored by timer 32 during a new base time interval.

The base interval timer 36 and the rest interval timer 26 are independent of each other and the respective time lengths may be set to the end user's preferences or factory preset. For example, the base interval time may be longer, such as sixty seconds, while the rest time interval may be shorter, such as thirty seconds, to allow sufficient time for the occupants of the premises to respond to the door.

The doorbell protection system operates to guard against abuse of continuous ring bells which ring as long as the door bell is pressed, as well as those which play a prerecorded sound sequence in response to a momentary actuation of the doorbell. The ring length timer protects against overly long ringing of the doorbell, whether continuous or intermittent, while the ring frequency counter protects against abusively repetitious, even if brief, actuation of the doorbell.

Simplified forms of the protection circuit 10 are also contemplated. For example, in an abuse protection system intended for use with the more modern, tune playing doorbells, the length of the sound sequence is set by the stored tune and does not depend upon continuous pressing of the doorbell switch 12. Also, repeated actuation of the doorbell switch is ineffective while a tune is playing in response to an earlier actuation of the doorbell switch. In such case, the ring length timer 32 may be omitted from the system 10 and only the ring frequency counter 20 left to detect abusive doorbell actuation.

Conversely, in some systems it may be desirable to provide only the ring length timer 32 without the ring frequency counter 20. In a minimal embodiment of the system 10 only the ring length timer 32 and the rest interval timer 26 are provided, and both base interval timer 36 and ring frequency timer 20 are omitted, so that limited abuse protection is offered only against continuous rings of excessive length.

In another embodiment particularly useful with such musical tune playing doorbells, the base time interval counter 36, the total ring length counter 32 and ring frequency counter 20 are omitted, and only a rest time interval counter 26 is provided and connected for disabling the signaling device 16 for a preset rest interval following a single actuation of the ringer device 12. In this embodiment the tune length is the same regardless of how often or how long the ringer 12 is actuated once play of the musical tune has been initiated by the signaling device 16. In effect, the ringer 12 is disabled for the duration of the tune once a single actuation is made of the signaling device 16. In such case, annoying rates of replay of the tune can be prevented by merely disabling actuation of the signaling device 16 for a preset rest interval following a single actuation of the ringer device 12. This last embodiment can be implemented by connecting the ring actuation input 22 directly to the rest interval timer start input 34, so that upon a first actuation of the ringer device 12 the rest interval count of counter 26 is started during which output 28 operates to open disabling switch 30. Also, instead of starting the rest interval timer start input 34 based upon actuation of the ringer device 12, an equivalent rest timer interval start input can be derived based upon termination of play of the musical tune generated by signaling device 16, rather than upon actuation of the ringer device 12. That is, the rest interval timer 26 is started when the musical tune ends, so that the disabling switch 30 is actuated at the end of the tune for the preset rest interval. In this last form of the invention the musical tune signaling device 16 is constructed to deliver an appropriate start input 46 to the rest interval timer 26 as suggested by the dotted line in the drawing.

A display 42 may be provided adjacent to the doorbell switch 12 to inform the visitor that the doorbell is momentarily disabled, for example by way of a flashing LED or other suitable warning device. The display 42 may include a countdown timer 44 showing lapse of the rest interval. For example, the timer display in the drawing shows 43 seconds remaining of the rest interval.

It is understood that the timer and counter circuits of the doorbell abuse protection system 10, including the cutoff switch 30, may be implemented in the form of a solid state integrated circuit which can be included at low cost in doorbell ringers for commercial distribution.

While a preferred and alternate embodiments of the invention have been described and illustrated for purposes of illustration and clarity, it will be understood that many changes, substitutions and modifications will become apparent to those having only ordinary skill in the art without thereby departing from the scope of the invention as defined in the following claims.

What is claimed is:

1. An improved doorbell installation having a ringer device connected for actuating a signaling device, the improvement comprising:

a ring frequency counter connected for disabling the signaling device upon the occurrence of a predetermined number of actuations of the signaling device within a preset first time interval, and a rest interval timer operative for re-enabling the signaling device after a preset second time interval, whereby excessively repetitive actuation of the signaling device is prevented.

2. The improvement of claim 1 further comprising base interval timer means for timing said first time interval.

3. The improvement of claim 2 wherein said base interval timer means is self resetting upon lapse of said first time interval.

4. The improvement of claim 2 wherein said rest interval timer is connected for resetting said base interval timer upon lapse of said second time interval.

5. The improvement of claim 1 wherein either or both said predetermined number of actuations and said second time interval are adjustable.

6. The improvement of claim 1 further comprising third timer means connected for disabling said signaling device responsive to a continuous actuation of said signaling device exceeding a third time interval.

7. The improvement of claim 1 further comprising fourth timer means for timing total signaling device actuation time prior to said disabling and bypass means for preventing said disabling if the total ring time is less than a preset acceptable fourth time interval.

8. The improvement of claim 1 wherein said predetermined number of actuations of the signaling device is a single actuation.

9. An improved doorbell installation having a ringer device connected for actuating a signaling device, the improvement comprising:

a ring length timer connected for disabling the signaling device upon actuation thereof in excess of a preset total ringer actuation time within a preset ring time interval, and a rest interval timer operative for re-enabling the signaling device after a preset rest interval following the disabling of the signaling device, whereby excessive actuation of the signaling device is prevented.

10. The improvement of claim 9 wherein said ring length timer is operative for disabling said signaling device responsive to either a continuous actuation of said ringer device exceeding said preset ring length time or a series of separate actuations jointly exceeding said preset ring length time within said preset ring time interval.

11. An improved doorbell installation having a ringer device connected for actuating a signaling device, the improvement comprising:

timer means connected for disabling said signaling device responsive to a continuous actuation of said ringer device exceeding a preset continuous ring time interval and a rest interval timer operative for re-enabling the signaling device after a preset rest interval following the disabling of the signaling device, whereby excessive actuation of the signaling device is prevented.

12. An improved doorbell installation having a ringer device connected for actuating a signaling device, the improvement comprising:

a ring frequency counter connected for disabling the signaling device upon the occurrence of a predetermined number of actuations of the ringer device within a preset first time interval, a ring length timer connected for disabling the signaling device upon actuation thereof in excess of a preset total ringer actuation time within a preset ring time interval, and a rest interval timer operative for re-enabling the signaling device after a preset second time interval following the disabling of the signaling device, whereby excessively repetitive actuation of the signaling device is prevented.

13. An improved doorbell installation having a ringer device connected for actuating a signaling device, the improvement comprising:

timer and counter circuits connected for determining a total ring duration in excess of a preset total ring length within a preset base time interval and for determining a predetermined total ring actuations of the signaling device within a preset base time interval; and disabling the ringer device for a predetermined rest interval upon the occurrence of at least one of said predetermined total ring actuations of the signaling device within a preset base time interval and said one or more ring actuations having a total ring duration in excess of a preset total ring length.

14. The improved doorbell installation of claim 13 wherein one or more of said predetermined base timer interval, said total ring duration and said predetermined total ring actuations are adjustable.

* * * * *